United States Patent [19]

Gutierres

[11] Patent Number: 4,529,185

[45] Date of Patent: Jul. 16, 1985

[54] MEDICAL EXAMINATION TABLE WITH FRACTIONED LEG SECTION

[76] Inventor: Alvaro A. G. Gutierres, Rua Paraná, 89, Bairro Santa Terezinha, 18100 Sorocaba, Sao Paulo, Brazil

[21] Appl. No.: 513,965

[22] PCT Filed: Oct. 18, 1982

[86] PCT No.: PCT/BR82/00016

§ 371 Date: Jun. 20, 1983

§ 102(e) Date: Jun. 20, 1983

[87] PCT Pub. No.: WO83/01379

PCT Pub. Date: Apr. 28, 1983

[30] Foreign Application Priority Data

Oct. 21, 1982 [BR] Brazil ..... 6101472

[51] Int. Cl.[3] ..... A61G 13/00

[52] U.S. Cl. ..... 269/326

[58] Field of Search ..... 269/322–328; 144/286 A, 286 R, 287

[56] References Cited

U.S. PATENT DOCUMENTS

| | | | |
|---|---|---|---|
| 542,060 | 7/1895 | Lentz | 269/326 |
| 574,999 | 1/1897 | Lamkin et al. | 269/326 |
| 799,702 | 9/1905 | Barlow | 269/326 |
| 2,299,127 | 10/1942 | Cawood | 269/328 |
| 2,596,986 | 5/1952 | Curtis . | |
| 2,606,801 | 8/1952 | Shampaine . | |
| 2,679,445 | 5/1954 | Roehm . | |
| 4,034,972 | 7/1977 | Peterson . | |

FOREIGN PATENT DOCUMENTS

| | | |
|---|---|---|
| 2922734 | 12/1980 | Fed. Rep. of Germany . |
| 657933 | 5/1929 | France . |
| 2203277 | 5/1974 | France . |

*Primary Examiner*—Robert C. Watson

*Attorney, Agent, or Firm*—Cushman, Darby & Cushman

[57] ABSTRACT

The Medical Examination Table is destined to patients under routine proctological examinations and ambulatorial anal surgeries. It consists on a table with the leg section being fractioned, so as to present two symmetric elements (3) and (4) with independent mobility, on the normal level of the table where the patient lies on. The two-split leg sections (3) and (4) rest on vertical elements (8) with supports (9), and are associated to the cabinet basis (5) by means of hinges (10), around which they hinge on, holding the desired position by means of rods (11) adjusted into grooves (12) on the side of the basis support (5). The base support of the table (5) is endowed with cabinets (1) for medical instrumentary and drawers (7) of either conventional or circular motion.

4 Claims, 5 Drawing Figures

MEDICAL EXAMINATION TABLE WITH FRACTIONED LEG SECTION

TECHNICAL FIELD

The present invention refers to a table destined to patients under routine proctological examinations, ambulatorial anal surgeries, made up to minimize the intrinsic difficulties to such clinical or surgical activities, which inhibit patients and restrict and weary the specialist physician who will conduct the examination.

BACKGROUND ART

The use of classical tables bring up two main kinds of difficulties: the ones related to patients and those related to the specialist doctor. Patients' difficulties refer to the positions they are submitted to in order to be examined, such as: the genupectoral (knee-shoulder) position, the lithotomy position and Sims' or left lateral position. The first two bring up discomfort and vexation to patients, and aged patients feel bad exhausted soon. The third position is favorable to patients but unfavorable to the examiner doctor, who finds it difficult to keep patients positioned under real adequate conditions to be examined, thus, having the examiner doctor little mobility for examining, due to the classic couch that restricts his acting. Moreover, when submitted to the above mentioned positions, due to vexation or conflict sensations, patient do not allow being positioned correctly, with the necessary flexion of the vertebral column, causing, then, discomfort to the examiner physician, which stand for another kind of difficulties.

As to Sims' position, patients as well the conventional couch may become unsuitable to the examiner ease. Thence, it follows that such difficulties restrict the possibilities of good proctological examinations.

DISCLOSURE OF INVENTION

The present invention is a table which leg sections are split lengthwise, so as presenting two components with independent mobility which are associated to the basis of the table by means of hinges around which they hinge on, and are kept still in certain desired positions by means of supporting rods which fit into grooves on the side of the basis of the table. The leg sections rest on two vertical components which stand for greater stiffness of the whole set. The table has a chest basis with cabinets and drawers for keeping medical instrumentary, reducing, then, room problems in the doctor's office.

BRIEF DESCRIPTION OF DRAWINGS

An embodiment of the invention will now be described, by way of example, with reference to the accompanying drawings, in which.

BEST MODE OF CARRYING OUT THE INVENTION

Figure 1:
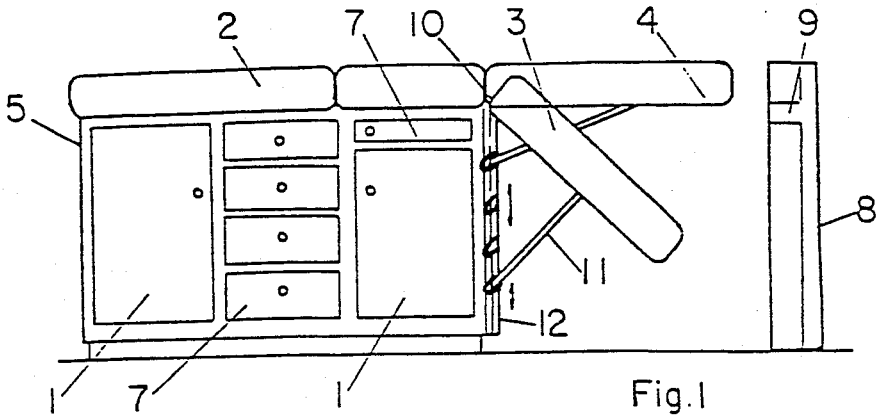
FIGS. 1 and 2 are, respectively, a front elevation and a plant views of the table for medical examination having one component of the leg section on the normal level of the couch while the other is with the inclination obtained by means of the supporting rods, and the vertical support elements are set apart of their respective leg sections in order to permit better visualization.
Figure 2:
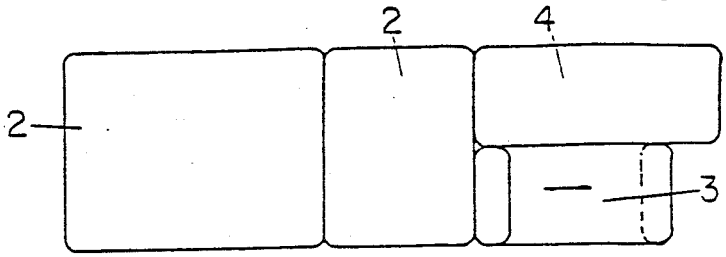

FIGS. 1 and 2 show that the mattress of the medical examination couch (2) is continuous up to the leg sections (3) and (4) which are associated to the basis (5) of the table by means of hinges (10). Under the matress (2), there is the table chest basis (5) with cabinets (1) and drawers (7), which can be either conventional or of circular motion.

Figure 3:
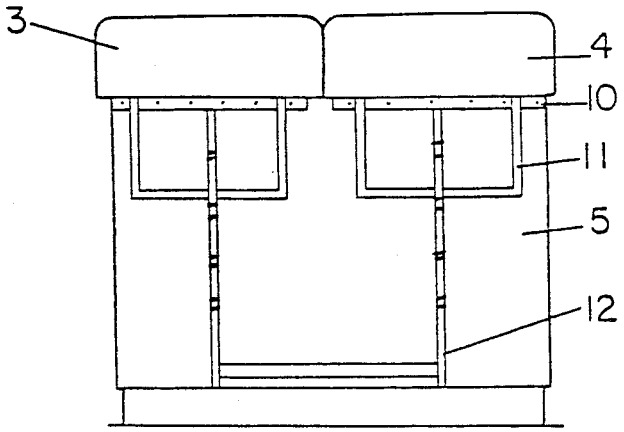
FIG. 3 is a lateral view of the medical examination table, showing the leg sections disposed on the normal level of the table, and the vertical components are detached in order to allow better visualization of the grooves, into which the support rods fit.
Figure 4:
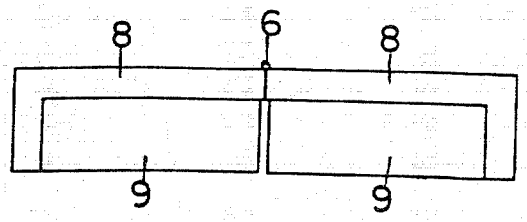
FIG. 4 is a plant view of the vertical elements joined by means of hinges and endowed with support on which the leg sections rests.
Figure 5:
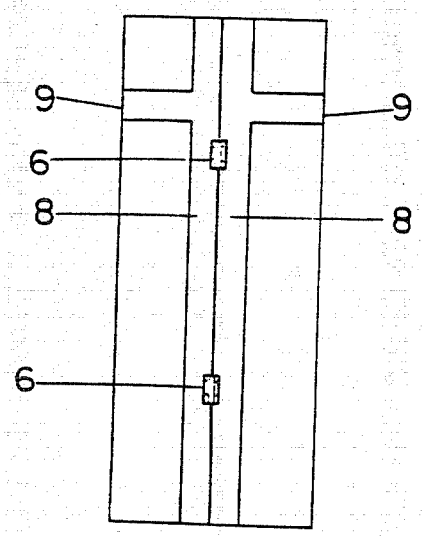
FIG. 5 is a front elevation view of the vertical elements folded in the middle, supporting one of the leg sections while the other is folded down.

FIG. 3 shows that, under the leg sections (3) and (4), we have the supporting rods (11) that fit into the grooves in the guiderails (12) in order to fix the leg sections (3) and (4) in the desired position. FIGS. 4 and 5 show that the vertical components (8) endowed with supports (9) are joined through hinges (6) offering independent motion to each leg section, resting one of the leg sections on the vertical elements (8).

The patient to be examined lies on the couch, in a way that his body stays on the mattess (2) and his legs on the respective leg section (3) and (4).

On the table of this present invention, patients can be placed in Sim's lateral position—more comfortable—and, since one of the leg section is folded down, the region to be examined becomes entirely exposed, in such a way that the examiner doctor can place himself exactly where the folded leg section formerly was, being, thus, either the rectosigmoidoscopy as well as mean ambulatorial surgeries, such as ligations and excisions under local anaesthesia, easily performed.

INDUSTRIAL APPLICABILITY

The medical examination table of this present invention can be produced through the common techniques used in manufacturing the chest basis of the table with cupboard and drawers, the metal motioned framework and, also, the matresses on the table itself and on the leg sections, which shall be manufactured with adequate material.

This couch is a suitable appliance for hospitals, clinics and doctors' offices.

I claim:

1. A medical examination table with separate leg supports, each leg support having one end hingedly attached to one end of said table so as to be pivotable about a horizontal axis each independently of the other leg support, each leg support having a top surface and a bottom surface with a movable supporting rod attached to each said bottom surface, said table having a side towards which said leg supports can pivot about said axis, said side having a plurality of spaced groove means each for engaging one of said supporting rods so that each said leg support can be fixed in a pivoted position relative to said table independently of the other leg support, each said leg support having a free end and a support stand means being provided which stand at a distance from said table to engage and support a said free end of at least one of said leg supports.

2. The table as claimed in claim 1 wherein said table is provided with a base having cabinets for instruments and the like.

3. The table as claimed in claim 1 wherein said groove means include parallel guide rails with each guide rail extending vertically on said side of said table and having a plurality of spaced grooves formed therein.

4. The invention as claimed in claim 1 wherein said leg support means has a base for engaging the floor said shelf means for engaging and supporting each said free end of each said leg support with said shelf means being foldable about a hinge axis to reduce the lateral width of said support stand means.

* * * * *